US006261123B1

(12) United States Patent
Kruger et al.

(10) Patent No.: US 6,261,123 B1
(45) Date of Patent: Jul. 17, 2001

(54) BATTERY PACK MANUAL DISCONNECT

(75) Inventors: Duane D. Kruger, Fishers; Georgette N. Young, Noblesville, both of IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/527,896

(22) Filed: Mar. 20, 2000

(51) Int. Cl.[7] ..... H01R 13/68

(52) U.S. Cl. ..... 439/511; 439/484; 439/680; 439/884; 439/911; 439/926

(58) Field of Search ..... 439/507, 511, 439/621, 157, 332, 333, 489, 490, 188, 411, 412; 200/501, 539, 538, 537, 540, 342, 523, 524

(56) References Cited

U.S. PATENT DOCUMENTS

| | | | |
|---|---|---|---|
| 5,562,490 | 10/1996 | Rybolt et al. | 439/507 |
| 5,635,817 | 6/1997 | Shiska | 320/25 |
| 5,700,165 | 12/1997 | Harris et al. | 439/621 |
| 5,823,808 | 10/1998 | Clark et al. | 439/157 |
| 5,850,909 | 12/1998 | Wagner | 200/501 |

FOREIGN PATENT DOCUMENTS

| | | | |
|---|---|---|---|
| 2582871 * | 5/1993 | (FR) | 439/621 |
| 632546 * | 5/1993 | (EP) | 439/621 |

* cited by examiner

*Primary Examiner*—Neil Abrams
*Assistant Examiner*—J. F. Duverne
(74) *Attorney, Agent, or Firm*—Margaret A. Dobrowitsky

(57) ABSTRACT

Described is a quick connect/disconnect 10 for an electrical system comprising first and second separated electrical current carrying connectors 43A, 43B, a source of electricity, each with a first and second, respectively, receptors 40A, 40B for receiving a metallic prong;

An electrical current carrying buss adapted to carry a pair of the metallic prongs 30A, 30B which cooperatively align, when connected, with the receptors of the current carrying connectors; and An electrically insulated handle 16, 18 that can be raised and lowered, which handle is attached at one end 24 to the buss and the opposite end adapted to be engaged such that in the lowered position the electrical system is connected so as to permit electrical current to pass from the first connector through the first receptor, through the metallic prong, through the buss to the other prong and to the second receptor, then to the second current carrying connector; and when the handle is in the raised position, current does not flow through the buss and the prongs are not aligned in the receptors.

9 Claims, 3 Drawing Sheets

BATTERY PACK MANUAL DISCONNECT

FIELD OF THE INVENTION

The invention is a quick connect/disconnect, utilized in an electrical system such as a battery pack utilized in vehicles such as electric vehicles.

BACKGROUND OF THE INVENTION

Electrical disconnects between high amperage, high voltage power supplies and the electrical loads they serve are described in patents such as U.S. Pat. No. Ser. 5,562,490. It is desirable to have such devices in vehicles such as electric vehicles to isolate the battery from the electric drive and control systems, particularly during maintenance of such systems or the battery. Significant considerations ought to be given to such electrical connects and disconnects in electric vehicles where volume weight and operating environment are important considerations. The electrical connect and disconnect in electric vehicles must not only have low mass and low volume, but also be simple to operate. In addition, the operating systems for the automotive environment require that all devices be subject to vibration, corrosion, and wide temperature variations and accordingly these are the parameters for consideration of desirable electrical connects and disconnects. High ampacity electrical quick disconnect is described in U.S. Pat. No. 5,700,165. Other patents of interest are: U.S. Pat. Nos. 5,635,817; 5,850,909; 5,823,808: 5.562.490: and 4,991,923.

It is the object of the present invention to provide a connect/disconnect for an electrical system whereby a handle can be operated manually to be raised and lowered such that electrical prongs, connected to a buss, directly connects to a receptacle which would facilitate the movement of electricity between connectors. These connections between the prongs and the receptors can be characterized as two rigid bodies which are forced together for surface to surface point of contact.

SUMMARY OF THE INVENTION

Described is a quick connect/disconnect for an electrical system comprising first and second separated electrical current carrying connectors for connection to a source of electricity, each with a first and second, respectively, receptors for receiving a metallic prong;

An electrical current carrying buss adapted to carry a pair of the metallic prongs which cooperatively align, when connected, with the receptors of the current carrying connectors; and An electrically insulated handle that can be raised and lowered, which handle is attached at one end to the buss and the opposite end adapted to be engaged such that in the lowered position the electrical system is connected so as to permit electrical current to pass from the first connector through the first receptor, through the metallic prong, through the buss to the other prong and to the second receptor, then to the second current carrying connector; and when the handle is in the raised position, current does not flow through the buss and the prongs are not aligned in the receptors.

DESCRIPTION OF PREFERRED EMBODIMENTS

The invention acts as a safety disconnect for vehicles serviced such as electric vehicles. It can also be used in any electrical system where a source of electrical power is distributed in multiple locations and there is a need to connect the sources of the electrical power. When the device is disengaged, a high resistance is introduced into the current path, making the pack safe for servicing.

The invention also acts as a pre-charge unit upon initial vehicle assembly. A pre-charge resistor, as described below, allows for a gradual charging of the power electronics utilized in electric vehicles. This insures that the electronics utilized in the vehicle are protected by limiting the flow of current when the battery pack is initially connected to the vehicle. The contacts are incorporated into the battery pack handle which acts to bypass the pre-charge resistor. When the handle is put in place, the full current of the battery pack is allowed to flow.

Figure 1:
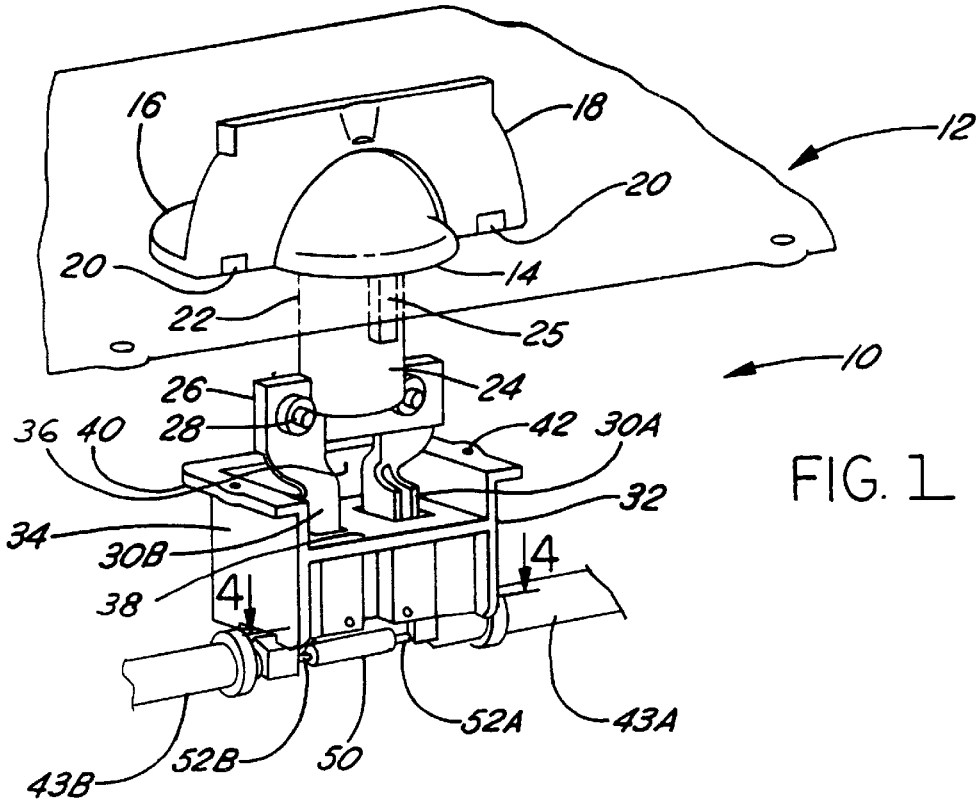
FIG. 1 is an isometric view of the electrical connect/disconnect of the present invention, showing the connection to the source of electrical power.
Figure 2:
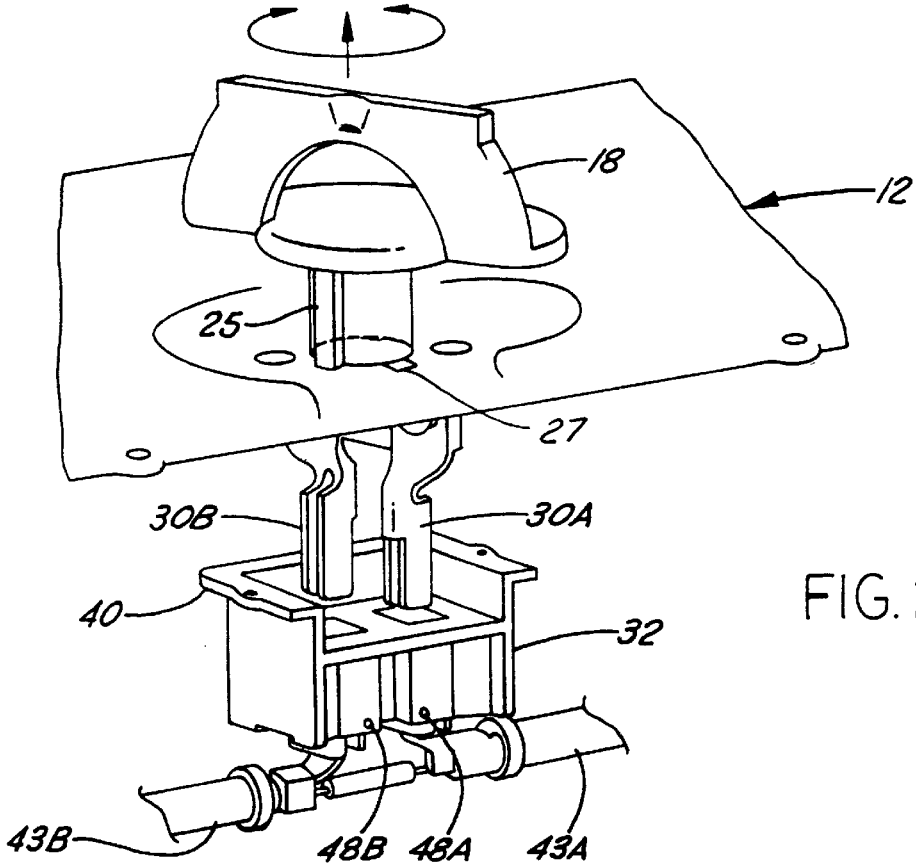
FIG. 2 is an exploded isometric view of the present invention in the disconnect mode, utilizing a lid for retaining the handle in the disconnect mode.

Turning now to a description of the drawings. FIG. 1 shows the electrical disconnect in a connect mode. The quick connect/disconnect 10 has a lid 12 in sectional view. The handle 14 is comprised of a stationary section 16 and a moveable section 18 which rotates on hinges 20. The stationary section 16 is attached to a stem section 22 which has a lug 25 positioned on the side of the member 22. A space from the handle of the stem section 22 is a lower portion 24 which is rotationally engaged with buss 26. Attached to the buss by nut and bolt 28 are male prongs 30A and 30B. The prongs, when in the connect stage, fit through housing 32 which has side members 34 and 36 as well as shelf member 38. A lip 40 is placed about the top of the side members, having apertures 42 for attachment to a desired substrate.

The handle 18, when lifted to the raised position can be rotated to maintain the lug 25 in a raised position and out of keyway 27 that is in the lid 12. When in the engaged position, the prongs 30A and 30B engage receptors 40A and 40B. When in the engaged position, the source of electricity from current carrying connectors 43A and 43B can permit the flow of electricity there between, namely between the current carrying connector 43A and 43B.

When the device is in the connect mode, pins 46 fit within apertures 48A and 48B to hold the receptacles 40A and 40B in place and, at the same time, to hold the male prongs 30A and 30B snugly attached to the receptacles. Alternatively, the pins may be placed under receptors 40A and 40B to secure the connection and limit the downward movement of the prongs.

Figure 3:
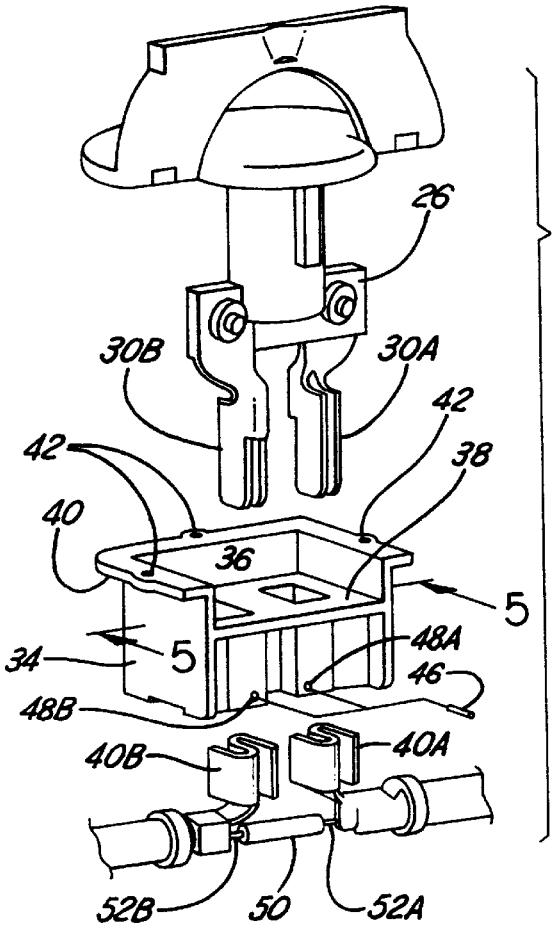
FIG. 3 is an exploded isometric view of the electrical connect/disconnect of the present invention.
Figure 4:
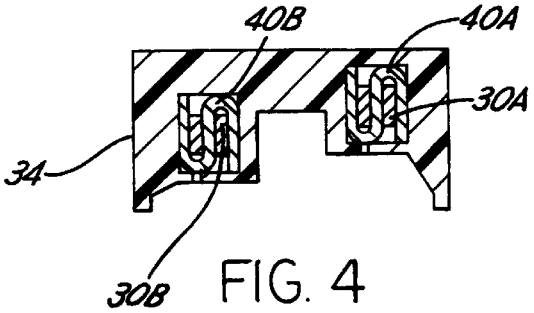
FIG. 4 is a view taken along lines 4—4 of FIG. 1.
Figure 6:
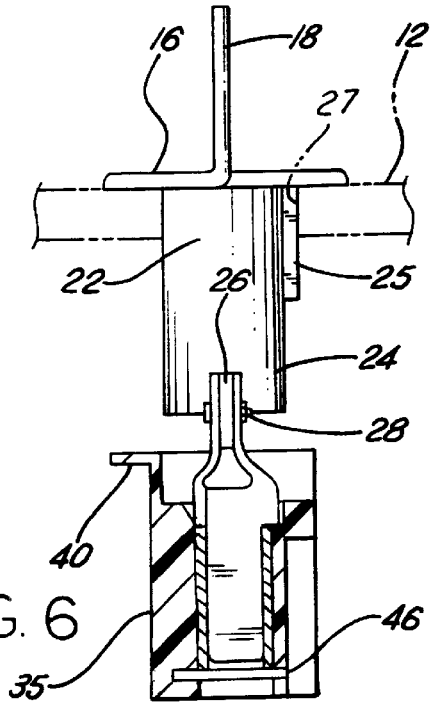
FIG. 6 is a side sectional view of FIG. 1 when viewed from the left side of FIG. 1.

As can best be seen in FIG. 3 and 4, the receptacles are sinusoidal in shape, that is, an S shape or configuration. The prongs 30A and 30B have a preferred C configuration so that the prongs snugly fit into the S configuration of the receptacle.

The connector is a Hertzian contact, that is, two rigid bodies being forced together into a "point" or surface contact.

Between the current carrying connector receptors 40A and 40B is a resistor 50 connected by wires 52A and 52B, respectively, that would connect directly with the electrical connectors 40A and 40B, respectively. The resistor 50 allows for gradual charging of the power electronics utilized in the vehicle. The resistor also insures that the electronics that are present in the vehicle are protected by limiting the flow of current when the battery pack is first connected to the vehicle. The pre-charge resistor is spliced into the crimps of the two female connector receptacles, or terminals, 40A and 40B at reference numerals 52A and 52B respectively.

Figure 5:
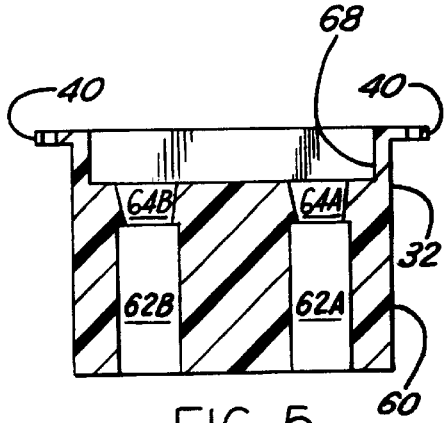
FIG. 5 is a view taken along lines 5—5 of FIG. 3.

The housing 32, as best shown in FIGS. 3–4, has a bottom section 60 with cavities 62A and 62B in which the receptacles 40A and 40B fit respectively. An upper section of the housing 64A and 64B are cut at an angle shown in FIG. 5 to facilitate the movement of the prongs, 30A and 30B into the receptacle 40A and 40B, thereby being properly aligned. The housing 32 has cutaway section 68 to facilitate the placement of the buss 26 therein when in the connect position.

In general, two male terminals or prongs 30A and 30B are connected by the buss bar 26 and are fitted into a slot (not shown) in the bottom portion 24 of the handle. When the handle is pushed down, the contractors are engaged. Lug 25 on the body of the handle aligns with keyway 27 in the lid to position the connectors for insertion. To disconnect, the handle may be pulled up to allow the lugs to clear the top of the lid. The handle can be rotated any number of degrees counterclockwise up to 90 degrees so that the lugs may rest on the lid and keep the handle in the up position.

A key feature of the invention is that there is a dual functionality of a pre-charge unit and a manual disconnect. The invention utilizes Hertzian contact technology to facilitate substantial close contact between the prongs of 30A and 30B and the connectors of 40A and 40B. All parts of the disconnect assembly are permanent features of the battery pack, that is that there are no removable parts. The flip-up feature of the handle permits it to be flush with the lid when the connection is engaged. The alignment of the contacts during engagement is aided by the funneled cavities 64A and 64B in the housing 32. Lug 25 on the body of the handle and keyway 27 aid in alignment of the handle. Quite simply for safety and convenience, the pack cannot be opened without disconnecting and cannot be reconnected while open, thereby ensuring operator safety. The pack can also be disconnected so that the vehicle can be serviced without having to open the battery pack.

Figure 7:
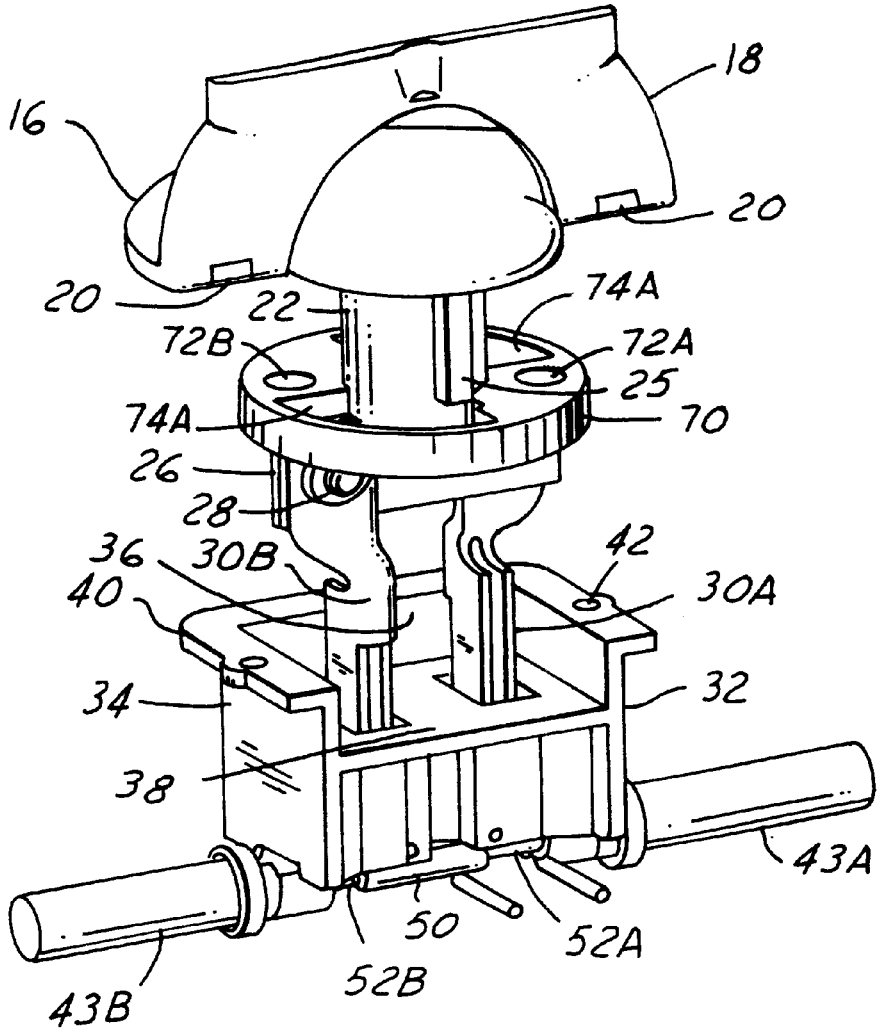
FIG. 7 is another embodiment of the invention depicting a plate to be secured to the handle of the electrical connect/disconnect.

FIG. 7 depicts an additional feature of the present invention. Plate 70 is bolted to the underside of lid 12 through apertures 72A and 72B. The plate permits motion of the handle 14 to rotate to disconnect the handle by permitting movement of the handle up to 90° counterclockwise. Key 25 therefore, when in the locked position, fits in open segments 74A and 74B.

It is understood that the following claims are intended to cover all of the generic and specific features of the invention herein described. And all statements of the scope of the invention which as a matter of language might be said to fall there between.

While the forms of the invention herein disclosed constitute presently preferred embodiments, many others are possible. It is not intended herein to mention all of the possible equivalent forms or ramifications of the invention; it is understood that the terms used herein are merely descriptive rather than limiting-and that various changes may be made without departing from the spirit or scope of the invention.

What is claimed is:

1. A quick connect/disconnect for an electrical system comprising first and second separated electrical current carrying connectors for connection to a source of electricity, each with a first and second, respectively, receptors for receiving a metallic prong;

An electrical current carrying buss adapted to carry a pair of the metallic prongs which cooperatively align, when connected, with the receptors of the current carrying connectors; and An electrically insulated handle that can be raised and lowered, which handle is attached at one end to the buss and the opposite end adapted to be engaged such that in the lowered position the electrical system is connected so as to permit electrical current to pass from the first connector through the first receptor, through the metallic prong, through the buss to the other prong and to the second receptor, then to the second current carrying connector; and when the handle is in the raised position, current does not flow through the prongs and buss and the prongs are not aligned in the receptors.

2. The quick connect/disconnect of claim 1 wherein the handle can be engaged manually to raise and lower it.

3. The quick connect/disconnect of claim 1 wherein the handle is adapted to have a lug which is aligned with a key way in a lid positioned near the handle such that when the handle is raised and rotated the lug is separated from the key way and locks the handle in the raised position.

4. The quick connect/disconnect of claim 1 further comprising an electrically insulated housing having a recess for each of the first and second receptors.

5. The quick connect/disconnect of claim 4 wherein the recesses are tapered to facilitate the insertion of the prongs into the receptors.

6. The quick connect/disconnect of claim 1 wherein the receptors are Hertzian contractor female terminals and the current carrying connectors are battery cables.

7. The quick connect/disconnect of claim 6 wherein the prongs and female terminals are held in place by retaining pins.

8. The quick connect/disconnect of claim 1 further comprising a resistor placed between the current carrying connectors and not electrically connected to the receptors such that when the handle is in the raised position current flow between the connectors passes through the resistor.

9. The system of claim 1 wherein the handle is attached to a plate which facilitates a rotation of the handle to disconnect the handle by permitting movement of the handle to a locked or unlocked position.

* * * * *